US010690468B2

(12) United States Patent
Eftestøl et al.

(10) Patent No.: US 10,690,468 B2
(45) Date of Patent: Jun. 23, 2020

(54) APPARATUS AND METHOD FOR FILLING BOREHOLES IN BLASTING OPERATIONS

(71) Applicant: QUICK PUMP, Øyestranda (NO)

(72) Inventors: Torleiv Eftestøl, Øyestranda (NO); Eivind Rødland, Tingvatn (NO)

(73) Assignee: QUICK PUMP, Øyestranda (NO)

( * ) Notice: Subject to any disclaimer, the term of this patent is extended or adjusted under 35 U.S.C. 154(b) by 0 days.

(21) Appl. No.: 16/316,103

(22) PCT Filed: Jun. 12, 2017

(86) PCT No.: PCT/NO2017/050153

§ 371 (c)(1),
(2) Date: Jan. 8, 2019

(87) PCT Pub. No.: WO2018/021915

PCT Pub. Date: Feb. 1, 2018

(65) Prior Publication Data

US 2019/0212119 A1 Jul. 11, 2019

(30) Foreign Application Priority Data

Jul. 26, 2016 (NO) ..... 20161230

(51) Int. Cl.
*F42D 1/10* (2006.01)
*F42D 1/12* (2006.01)

(52) U.S. Cl.
CPC ..... *F42D 1/10* (2013.01); *F42D 1/12* (2013.01)

(58) Field of Classification Search
CPC ..... F42D 1/10; F42D 1/12
USPC ..... 102/313; 86/20.15
See application file for complete search history.

(56) References Cited

U.S. PATENT DOCUMENTS 3,354,771 A 11/1967 Stark
3,943,820 A 3/1976 Persson
4,730,534 A * 3/1988 Dupont ..... G05D 9/04 86/20.1

(Continued)

FOREIGN PATENT DOCUMENTS

| | | |
|---|---|---|
| DE | 1074470 | 1/1960 |
| GB | 2204343 | 6/1994 |
| JP | 06174399 | 6/1994 |

OTHER PUBLICATIONS

International Search Report issued in PCT/NO2017/050153, dated Jul. 9, 2017, pp. 1-3.

(Continued)

*Primary Examiner* — Bret Hayes
(74) *Attorney, Agent, or Firm* — Jeffrey S. Melcher; Melcher Patent Law PLLC

(57) ABSTRACT

An apparatus and method for filling boreholes with dry mass such sand, gravel, concrete and dry mortars or other similar materials from a deposit or a truck in blasting operations. The apparatus includes a container for storage of mass, conveying device with a conveyor screw for conveying the mass from the container into a hose and a compressed air supply for directing flow of the mass in the hose towards a dispenser. The compressor air supply is adapted to forcibly urge the mass into boreholes. The dispenser is adapted for positioning over the boreholes for filling with mass before blasting operations.

10 Claims, 1 Drawing Sheet

(56) References Cited

U.S. PATENT DOCUMENTS

| | | | | |
|---|---|---|---|---|
| 5,712,440 | A * | 1/1998 | Eagar | C06B 21/00<br>102/313 |
| 6,070,511 | A * | 6/2000 | Palmer | F42D 1/10<br>102/313 |
| 6,397,719 | B1 * | 6/2002 | Vestre | C06B 21/00<br>86/20.15 |
| 9,846,020 | B2 * | 12/2017 | Mykkanen | F42D 1/18 |

OTHER PUBLICATIONS

Written Opinion issued in PCT/NO2017/050153, dated Jun. 9, 2017, pp. 1-3.

* cited by examiner

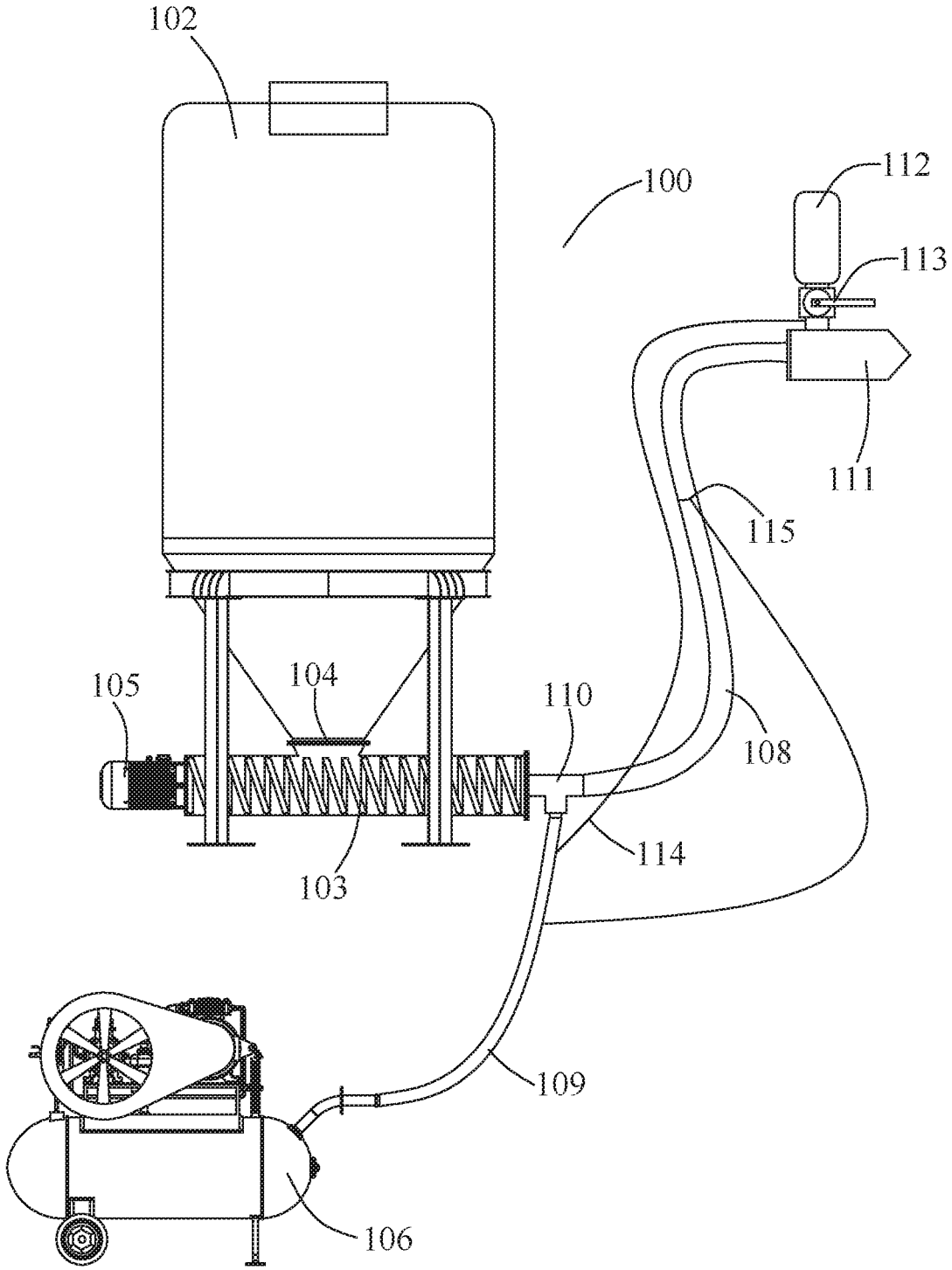
102
100
112
113
111
115
105
104
110
108
114
103
109
106

APPARATUS AND METHOD FOR FILLING BOREHOLES IN BLASTING OPERATIONS

The present disclosure belongs to the field of construction machinery equipment. More specifically the disclosure relates to an apparatus and method for filling boreholes with sand, gravel, concrete and dry mortars or other similar materials from a deposit or a truck during preparation for rock and other blasting operations.

BACKGROUND OF THE INVENTION

Sand, gravel, concrete and dry mortars or other similar materials are used in a variety of applications for the construction industry. What has been a common problem is moving these materials from a truck and/or crane, or deposit to the place where it is being used. At many constructions areas when a truck and/or crane, or a deposit do not have an easy access, labour carries buckets of these materials from a truck or deposit and pours it into the borehole spot where the materials are being used.

Generally, Slurry gravel pumps are the most appropriate for all types of hydraulic sluicing mining operations which eliminate the necessity of carrying Sand, gravel, concrete and other similar materials by workers for mining output removal. Slurry gravel pumps are highly efficient, shaft driven having a pump body, which can be used in drilling in water carrying loose solid or layer. Slurry gravel pumps are placed on the bottom layer and by preferably rapid lifting means Sand, gravel, concrete or the like are inwardly sucked into the pump body and pulled to the drain from borehole or from the drill pipe. Slurry gravel pumps are primarily used in removing slurry gravel from the mining area and further transporting the Slurry gravel to the deposit area, whenever trucking the slurry gravel is inapplicable or not feasible. The other usage is for removing and transporting slurry gravel from a temporary tailings dam at the treatment plant site, away to a permanent disposal dam site.

Further, mortar pumps are widely recognized for long or short delivery of fine materials in building/construction sites. The mortar pumps are for distributing and shaping the ballast of a railroad bed and are designed for masonry block fill, piling encasements, pea gravel pumping, concrete levelling and other grouting applications. Conventional mortar mumps are plaster spraying machines used for thin layer finishing coat sprayer and mixing and conveying. These are also known as grouting pumps used for grouting in soil, earth foundation stabilization, waterproofing, tunnel lining, underwater foundations, bridge decks, deep well casing, slope line grouting, etc. These can be used in pumping cement, mud, slurry, concrete slurry water and other media into void areas.

Again in the construction industry such as for building houses, mortar pumps are used for filing cavities in walls, slabs and the like where wet sealing materials (Sand, gravel, concrete, cement and other similar materials) are mixed in a certain proportion and are introduced to cover the cavities. Traditionally, the mortar pumps can quickly, easily, accurately and inexpensively place wet sealing materials into the target cavities.

Also, there are other pumps designed originally to remove sand, gravel, organics or any other material from water wells. The Pumps have also been used for water production for residential, agricultural and oil wells.

Most often, all these pumps generally comprise of high-pressure air supply system, a pumping mechanism and a discharging mechanism. Various mixtures such as water, mud, sand and rock ballast can be pumped out of a pit by using pressure of compressed air.

Moreover, in construction industry such as for building houses, roads, rails etc., the need for blasting away rock formations is sometimes inevitable. It is an established practice in the preparation for blasting operations, to drill in at the same time a series of sets of blast holes which are to be successively filled with explosives. And further before blasting, the boreholes are filled with filling material (Sand, gravel, concrete and dry mortars or other similar materials) manually, by the labours carrying buckets of filling material from a truck or a deposit and pour into the boreholes. This is not only time consuming, but also very laborious. The filing work causes inconvenience and an additional expense to the blasting operations. The filling of borehole before blasting generally uses conventional manual methods. There is another problem that sometimes the boreholes are tens to hundreds of meters in depth, resulting in some sections not filling up completely leaving air gaps in the borehole. Over time, many attempts have been made at solving this problem; however, manually filling the boreholes continues to be the only method. Even with manually filling the boreholes there is no guarantee that the boreholes will be filled tightly for effective blasting operations.

In order to fill the boreholes before blasting, there exists a need to develop a solution that may eliminate the necessity of carrying Sand, gravel, concrete and dry mortars or other similar materials by workers for filling the boreholes. Further, there exists a need of a portable, self-contained quick acting machine pump that is capable of discharging filling material into hard-to-reach areas, as well as providing assistance in covering large number of boreholes with filling material in a short time. Further, there exists a need for a machine pump and a method to permit the application of filling materials into areas that are normally inaccessible and would require many hours of human labour.

SUMMARY OF THE INVENTION

The present invention relates to an apparatus for filling boreholes before blasting operations wherein the apparatus comprising a container for storing mass from a truck or a deposit, a conveying device with conveyor screw for drawings mass from the container, a hose immediate at end of the conveyor screw for delivering mass into a dispenser, and a vacuum pump for sucking the mass into the dispenser which finally discharges the mass into boreholes.

It is the primary object of this invention to provide an apparatus which is not only efficient but provides a simplified construction while offering an increased variety and flexibility of filling boreholes in ballast operations.

This object is achieved in that the apparatus according to the invention comprises; a container for storing mass, a conveyor screw at bottom of the container for feeding mass into a hose, a whisk or vibrator mounted above the conveyor screw in the container for guiding the uniformly mixed mass into the conveyor screw for feeding into the hose, a compressor having pipes for supplying highly compressed air into the hose, a vacuum pump for creating suction pressure at the end of the hose, and a dispenser for poring the mass into the boreholes, the apparatus characterized in that a pipe from the compressor is connected into the hose immediately at the conveyor screw for directing flow of the mass toward the dispenser, further characterized in that another pipe along the length of the hose for providing extra lift and finally into the vacuum pump for suction and for immediate extra lifts for discharging the mass into borehole from the dispenser.

The mass is dry mass such as sand, gravel, concrete and dry mortars or other similar materials that are associated either directly or indirectly with filing material. Generally, the mass is fine material of sand, gravel, concrete and dry mortars can be of any kind which can be suitably used with this apparatus.

It is also understood that a compressor supplies highly compressed air that carries the mass under pressure in the hose. A source of compressed air communicates with the hose via an interconnection immediately at the exit end of the conveyor screw for directing flow of the mass toward the dispenser. Thereby mass is delivered under pressure through the hose into the dispenser.

Further, the vacuum pump creates vacuum at the end of the hose, so that the mass when it reaches the end of the hose, due to vacuum pressure increase the speed of delivery of mass into the boreholes. Further, a vacuum pump valve is configured in the vacuum pump; the vacuum pump valve can be opened for discharging the mass from the dispenser into the boreholes. A pipe for compressed air supply is also attached to the vacuum pump to provide immediate extra lifts for discharging mass into the boreholes.

In addition, a vacuum pump valve is configured with the vacuum pump so that the mass from the dispenser is discharged out into the boreholes with extra pressure, when the vacuum pump valve is opened.

According to one embodiment of the invention, a method of filling boreholes with mass before blasting operation comprises, storing mass into a container, wherein the mass is feed into a hose by means of conveying device consisting of a conveyor screw, a whisk or vibrator configured just above the conveyor screw. The hose is supplied with highly compressed air from a compressor immediately after the conveyor screw, characterized in that, the highly compressed air causes the mass to travel in the hose toward a dispenser, wherein the dispenser which is at end of the hose is filled with the mass supplied from the container, further highly compressed air is again supplied at the dispenser through a vacuum pump to provide extra pressure for discharging the mass into boreholes from the dispenser.

Thereafter, the dispenser is introduced into a borehole until the borehole is substantially full. To do this, the hose is preferably movable, light weight that can be carried by the manual labour into opening of the boreholes.

Preferably the apparatus is mounted on a truck or configured with bearing wheels for allowing movement at the construction site.

The above and other objects, advantages and features of this invention will become more apparent from the following detailed description of a preferred embodiment thereof taken in conjunction with the accompanying drawing.

BRIEF DESCRIPTION OF DRAWINGS

The invention will be better understood by reading the detailed description given below, for information, but not limiting, with reference to the accompanying drawing, wherein:

FIG. 1 shows a schematically a perspective view of an apparatus for filling boreholes according to an embodiment of the invention;

DETAILED DESCRIPTION OF THE INVENTION

The invention describes an apparatus and method for introducing dry mass into boreholes in blasting operations. In the discussion of the present disclosure, the term dry mass is used to indicate sand, gravel, concrete and dry mortars or other similar materials that are associated either directly or indirectly with filling material. Generally, mass is fine material of sand, gravel, concrete and dry mortars can be of any kind which can be suitably used with this apparatus. The apparatus can significantly improve the efficiency of construction site and reduce construction costs in the blasting operations.

Referring first of all to FIG. 1, an apparatus 100 includes the following major components namely a container 102 for storing mass from a truck or deposit, a conveying device with conveyor screw 103 at bottom of the container 102 for feeding mass into a hose 108, a whisk or vibrator 104 mounted in the container above the conveyor screw 103 to slide the mass through conveyor screw 103 for feeding into the hose 108, a compressor 106 having a pipe 109 for supplying high pressure compressed air into the hose 108, a vacuum pump 112 for creating suction pressure at the end of the hose 108, and a dispenser 111 for poring the mass into the boreholes.

Container 102 is normally mounted onto a frame or on a truck not shown in the diagrams or placed at construction site and will hold dry mass. In the container 102 at bottom a conveyor screw 103 is configured horizontally for feeding mass out from the container 102. Therein a whisk or vibrator 104 is mounted which feeds the mass smoothly into the conveyor screw 103. The mass through the conveyor screw 103 is delivered into the hose 108.

The frame comprises a platform for placing the container with combination of conveyor screw 103, an actuation device 105 and whisk or vibrator 104. The frame is provided with a plurality of retractable support arms and may also comprise a pair of wheels not shown in diagram for moving the apparatus 100. The frame may comprise wheels for the movement of the apparatus 100 at the construction site. But in general the apparatus 100 can be deployed onto a truck.

As shown in FIG. 1, an actuation device 105 for actuating the conveyor screw 103 for feeding of the mass into the hose 108 from the container 102. The actuation device 105 can be of any kind known in the art including motor, pneumatic, hydraulic and/or other types of mechanical actuation. The conveyor screw 103 and whisk or vibrator 104 is configured with the actuation device 105 thereby allowing rotation of the conveyor screw 103 and driving whisk or vibrator 104 for continuous feeding of mass into the hose 108. To avoid bleeding and consistency loss of the mass occurring due to gravity, the bottom end of the conveyor screw 103 is shielded with the container 102. Conveyor screw 103 extending through the bottom of the container 102 can be fixed in the bottom of the container 102.

In addition, the whisk or vibrator 104 may be mounted in the container 102 above the conveyor screw 103, thereby the allowing whisk or vibrator 104 force urge the mass in the container 102 into the conveyor screw 103 smoothly. In some embodiments, the whisk or vibrator 104 stirred the container vertically. The whisk or vibrator 104 may comprise at least one stirring shaft and a plurality of the stirring blades.

A source of compressed air i.e., compressor 106 for supplying highly compressed air to carry the mass under pressure into the hose 108. A pipe 109 for source of compressed air communicates with the hose 108 via an interconnection 110 immediately at the conveyor screw 103 exit end for directing the flow of mass towards the dispenser 111. Thereby mass is delivered under pressure through hose 108 into the dispenser 111. The compressibility of the compressed air will also affect the amount of mass that is delivered as does the viscosity of the mass, by preferably smooth rapid flow of mass through the hose 108.

A vacuum pump 112 creates vacuum at the end of the hose 108, so that the mass when it reaches the end of the hose 108, due to vacuum pressure increase the speed of delivery of mass into the borehole. Further, a vacuum pump valve 113 in the vacuum pump 112 is opened for discharging the mass from the dispenser 111 into the boreholes. A pipe 114 for compressed air supply is also attached to the vacuum pump 112 to provide immediate extra lifts for discharging mass into the boreholes. Basically while in the hose 108 at the starting point the mass is pushed by highly compressed air from the pipe 109, but towards the end point the pressure of the compressed air drops significantly as air escapes through the mass while it is travelling through the hose 108. Also the hose 108 may be lying on uneven surfaces in the rocky areas, thereby encountering pushing of mass through heights. Having a vacuum pump 112 at the receiving end helps pulling the mass by suction pressure in the dispenser before discharging of the mass in the boreholes.

In order to ensure that the discharging of the mass from the dispenser 111 into the boreholes is done rapidly, opening of the vacuum pump valve 113 will help to push the mass from the dispenser 111 outward with pressure.

Further, a pipe 115 from the compressor can be configured with the hose at a distance from the first pipe to provide extra lift and accelerate flow of the mass toward the dispenser 111.

It will be seen that an apparatus 100 of this character is extremely simple, that it may be readily operated by any ordinary air compressor such as commonly used by construction/building industries adapted for pumping wet or slurry sand, gravel. The pumping mechanism may be made, of course, of any desired size for any conditions of work, and it may be made very portable so that it may be carried around from one job to another. The Apparatus is particularly designed to take the place of an existing gravel pump or mortar pump used for pumping out and transporting mass, but it does away with the necessity of detailing a workman for the purpose of operating the pump, and eliminates the necessity of using a motor operated pump provided with pistons, valves and other parts liable to be worn away by the sand or gravel.

Therefore, the mass being made capable to move along using a whisk or vibrator 104 into the conveyor screw 103 and thereafter, moves along hose 108 towards the dispenser 111 and thereafter being filled into boreholes.

The apparatus 100 performs the task of introducing a defined amount of mass in the boreholes in blasting operation in a quick and simple procedure.

Further, the apparatus 100 can be used for depositing of filling small canals or cavities with mass during building construction. Furthermore, the invention provides a method for depositing mass into small canals or cavities during a building construction and/or in a building.

It should be apparent to persons skilled in the arts that various modifications and adaptation of this structure described above are possible without departure from the spirit of the invention the scope of which is defined in the appended claim.

The invention claimed is:

1. An apparatus for filling a borehole with mass before blasting operations, the apparatus comprising:

a container for storing mass;

a hose for conveying the mass;

a conveyor screw at bottom of the container for feeding the mass into the hose, a first end of the hose is connected to a conveyor screw exit;

a whisk or vibrator mounted above the conveyor screw in the container for guiding the mass into the conveyor screw;

a compressor having a first pipe for supplying highly compressed air into the hose;

a vacuum pump for creating suction pressure at a second end of the hose opposite the first end of the hose; and a dispenser at the second end of the hose for pouring the mass into the borehole, wherein the first pipe from the compressor is connected into the hose immediately at the conveyor screw exit for directing flow of the mass towards the dispenser, and a second pipe from the compressor is attached into the vacuum pump to immediately provide extra air pressure for discharging the mass into the borehole from the dispenser.

2. The apparatus according to claim 1, wherein the container receives the mass from a truck or a deposit.

3. The apparatus according to claim 1, wherein a vacuum pump valve is configured with the vacuum pump so that the mass from the dispenser is discharged out into the boreholes with extra air pressure from the second pipe, when the vacuum pump valve is opened.

4. The apparatus according to claim 1 further comprising a third pipe from the compressor connected to the hose at a distance from the first pipe to provide extra lift and accelerate flow of the mass towards the dispenser.

5. The apparatus according to claim 1, further comprising an actuation device for actuating the conveyor screw for feeding of the mass into the hose from the container.

6. A method of filling a borehole with mass before blasting operation using an apparatus a container for storing mass;

a hose for conveying the mass;

a conveyor screw at bottom of the container for feeding the mass into the hose, a first end of the hose is connected to a conveyor screw exit;

a whisk or vibrator mounted above the conveyor screw in the container for guiding the mass into the conveyor;

a compressor having a first pipe for supplying highly compressed air into the hose;

a vacuum pump for creating suction pressure at a second end of the hose opposite the first end of the hose; and a dispenser at the second end of the hose for pouring the mass into the borehole, wherein the first pipe from the compressor is connected into the hose immediately at the conveyor screw exit for directing flow of the mass towards the dispenser, and a second pipe from the compressor is attached into the vacuum pump to immediately provide extra air pressure for discharging the mass into the borehole from the dispenser, the method comprising:

supplying the mass into the containers;

feeding the mass from the container into the hose by means of the conveyor screw at the same time by means of the whisk or vibrator;

supplying the hose with highly compressed air from the compressor immediately after the conveyor screw exit through the first pipe;

wherein the highly compressed air causes the mass to travel in the hose towards the dispenser;

supplying the suction pressure to the second end of the hose from the vacuum pump;

wherein the dispenser is filled with the mass supplied from the container; and supplying highly compressed air from the compressor through the second pipe to the dispenser through the vacuum pump to provide extra air pressure for discharging the mass into a first borehole from the dispenser.

7. The method according to claim 6, further comprising placing the dispenser in a second borehole until the second borehole is substantially full of the mass.

8. The method according to claim 6, wherein a vacuum pump valve is configured with the vacuum pump, wherein the method further comprises discharging the mass from the dispenser into the first borehole with extra air pressure; when the vacuum pump valve is opened.

9. The method according to claim 6, wherein a third pipe from the compressor is connected to the hose at a distance from the first pipe, wherein the method further comprises supplying compressed air through the third pipe to provide extra lift and accelerate flow of the mass toward the dispenser.

10. The method according to claim 6, wherein the whisk or vibrator is mounted above the conveyor screw, wherein the method further comprises operating the whisk or vibrator to smoothly guide the mass into the hose.

* * * * *